US005222338A

United States Patent [19]

Hull et al.

[11] Patent Number: 5,222,338

[45] Date of Patent: Jun. 29, 1993

[54] PREFABRICATED CONCRETE WALL

[76] Inventors: Harold L. Hull, 401 Canyon Way #43, Sparks, Nev. 89434; David M. Bates, 710-145 Tamarack, Susanville, Calif. 96130

[21] Appl. No.: 667,951

[22] Filed: Mar. 12, 1991

[51] Int. Cl.[5] ..... E04B 2/02

[52] U.S. Cl. ..... 52/405; 52/410; 52/602; 52/612

[58] Field of Search ..... 52/274, 295, 293, 511, 52/512, 612, 410, 602, 247, 709, 300, 574, 405; 411/339, 322

[56] References Cited

U.S. PATENT DOCUMENTS

| | | | |
|---|---|---|---|
| 1,421,007 | 6/1922 | Howell | 52/602 |
| 1,462,622 | 7/1923 | Phelan | 52/574 |
| 2,132,950 | 10/1938 | Green | 411/339 |
| 2,137,767 | 11/1938 | Betcone | 52/62 |
| 2,182,470 | 12/1939 | Erdman | 52/410 |
| 2,208,589 | 7/1940 | Leemhuis | 52/300 |
| 2,521,381 | 9/1950 | Linck | 52/300 |
| 3,115,804 | 12/1963 | Johnson | 411/338 |
| 3,491,820 | 1/1970 | Ostling | 52/582 |
| 3,609,935 | 10/1971 | Thomas | 52/601 |
| 3,677,512 | 7/1972 | Thomas | 249/48 |
| 3,688,458 | 9/1972 | Inmon et al. | 52/766 |
| 3,994,107 | 11/1976 | Aughuet | 52/582 |
| 4,164,831 | 8/1979 | Messick et al. | 52/405 |
| 4,194,333 | 3/1980 | Paton et al. | 52/709 |
| 4,320,606 | 3/1982 | Ganga Rao | 52/125 |
| 4,438,607 | 3/1984 | Nelson | 52/247 |
| 4,605,529 | 8/1986 | Zimmerman | 264/263 |
| 4,691,490 | 9/1987 | Leaver | 52/293 |
| 4,735,022 | 4/1988 | Pardo | 52/221 |
| 4,751,803 | 6/1988 | Zimmerman | 52/414 |
| 4,815,243 | 3/1989 | Pardo | 52/100 |
| 4,841,705 | 6/1989 | Fuhrer | 52/410 |
| 4,862,660 | 9/1989 | Raymond | 52/221 |
| 4,872,823 | 10/1989 | Howard | 425/64 |
| 4,884,382 | 12/1989 | Horobin | 52/426 |
| 4,934,121 | 6/1990 | Zimmerman | 52/583 |

FOREIGN PATENT DOCUMENTS

| | | | |
|---|---|---|---|
| 481597 | 3/1952 | Canada | 52/612 |
| 876226 | 10/1942 | France | 52/293 |
| 483295 | 7/1953 | Italy | 52/602 |
| 588580 | 5/1947 | United Kingdom | 52/274 |
| 839477 | 6/1960 | United Kingdom | 52/602 |

*Primary Examiner*—James L. Ridgill, Jr.

[57] ABSTRACT

A prefabricated concrete wall with outer and inner wall panels seperated by a rigid insulation panel and air cavities, that allows each wall to expand and contract independently. Mounting brackets are embedded in the panels to allow the inner panel to be raised and dropped into place and openings for doors and windows are provided as well as cavities for electrical service panels, plumbing, electrical boxes, etc. The outer panels are joined together by pins and the base mounting brackets have slotted holes to allow the panels to expand and contract. Also, the outer surfaces of both the inner and outer panels may have finished surfaces to take the appearance of stucco, bricks, stones, or wood panels, etc.

11 Claims, 6 Drawing Sheets

FIG 4
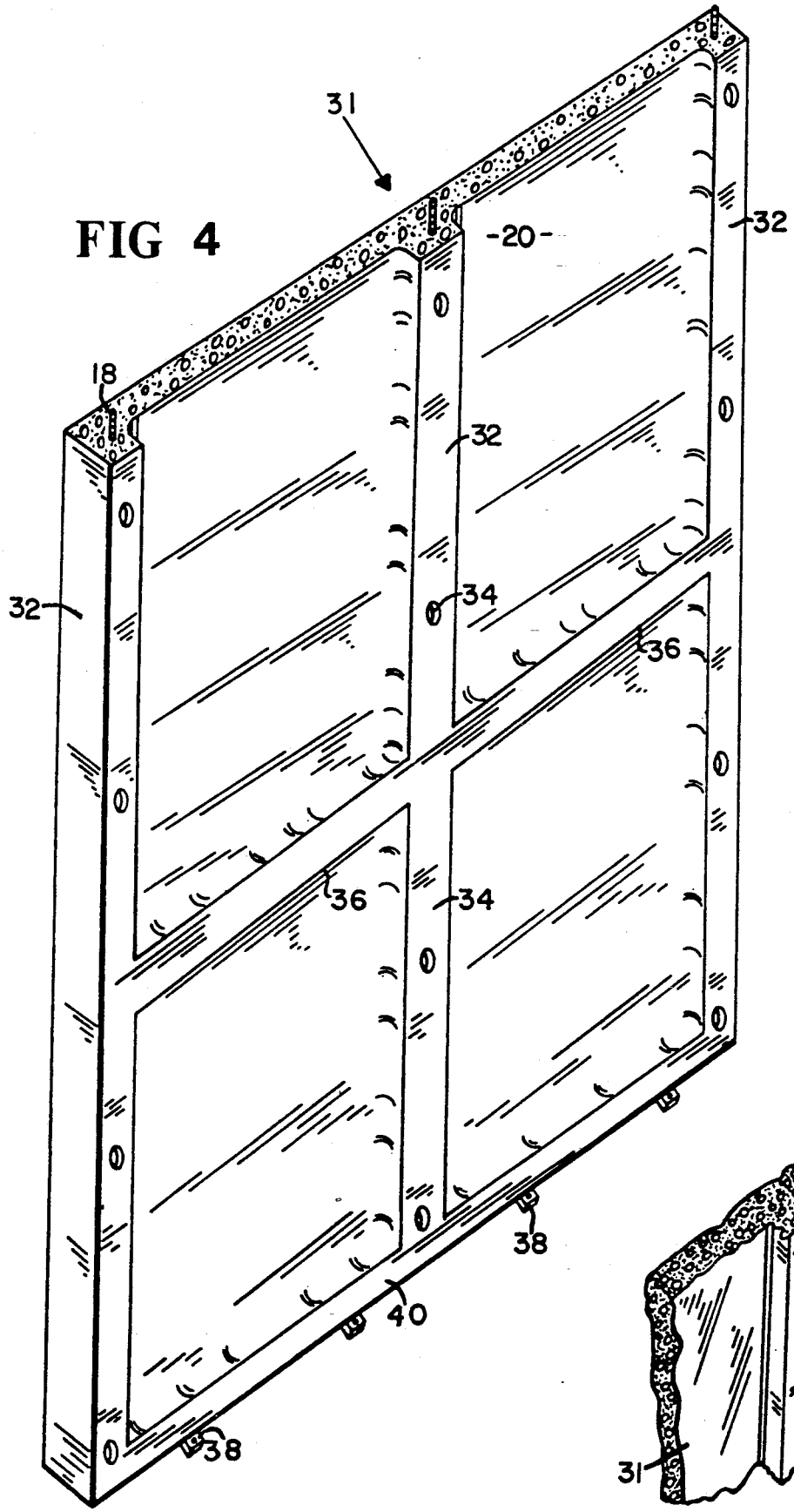
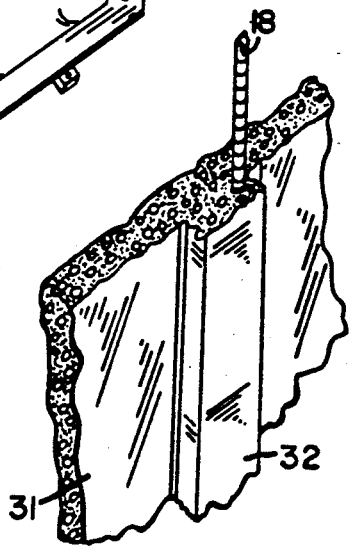
FIG 5

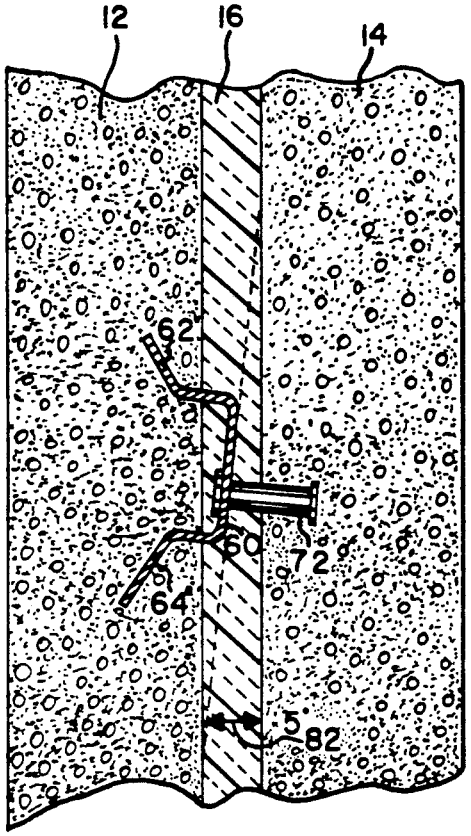
FIG 11
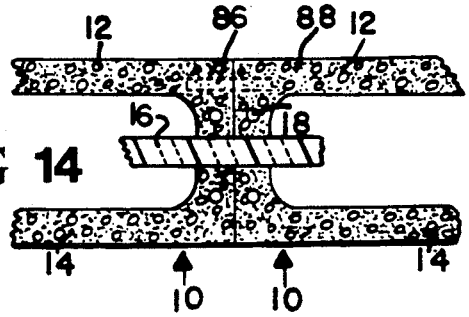
FIG 14
FIG 15
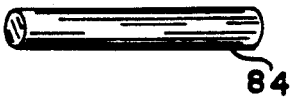
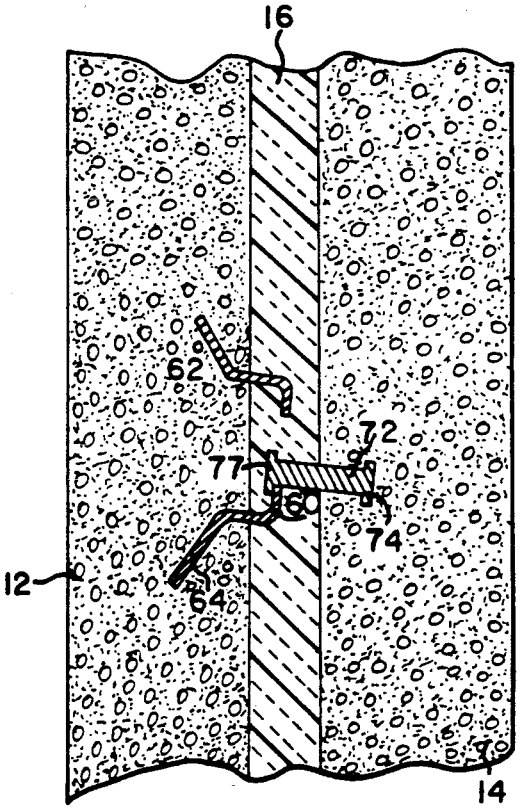
FIG 12
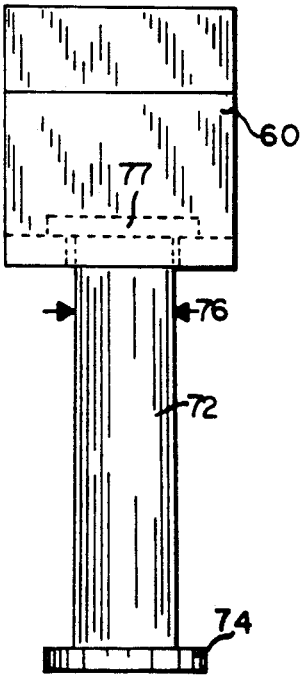
FIG 13

FIG 16
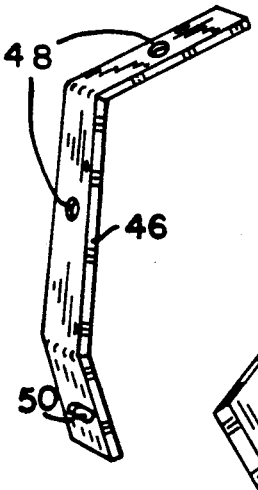
FIG 17
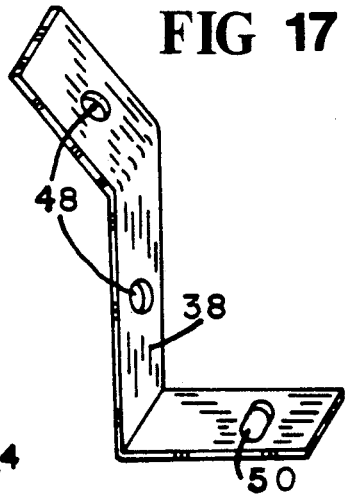
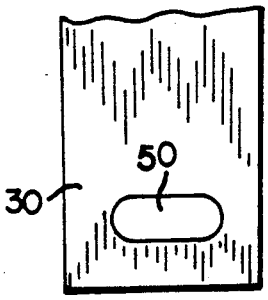
FIG 18
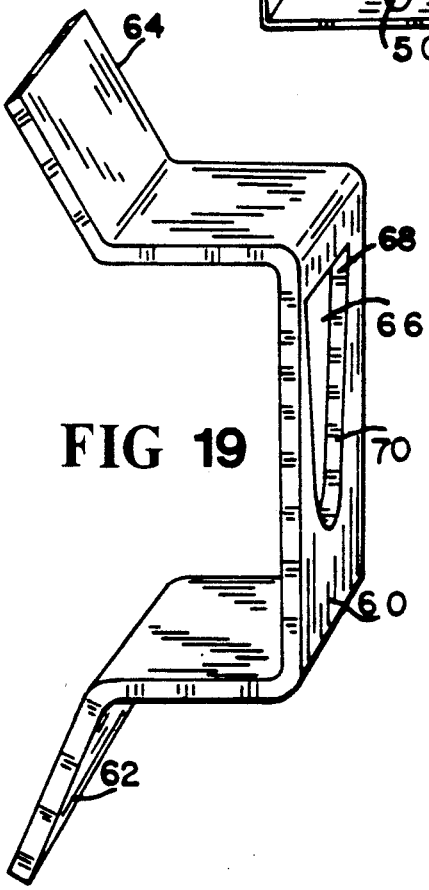
FIG 19
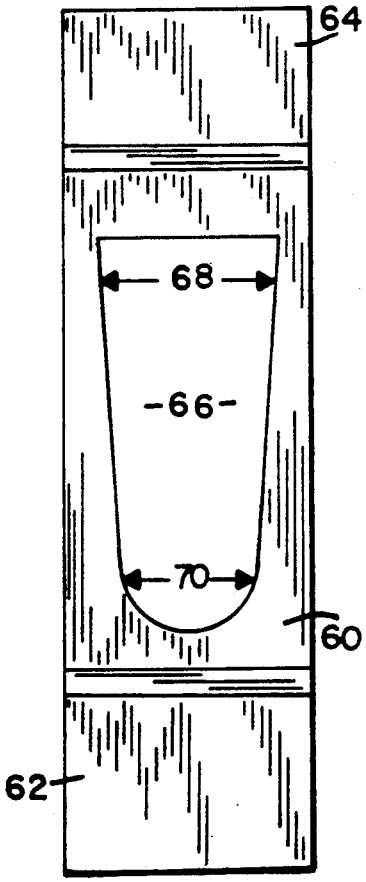
FIG 20
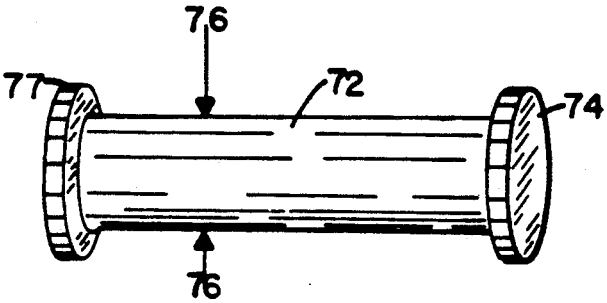
FIG 21
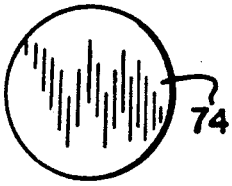
FIG 22

PREFABRICATED CONCRETE WALL

FIELD OF THE INVENTION

This invention relates to concrete walls but more specifically to a wall having inner and outer panels with insulation between them.

BACKGROUND OF THE INVENTION

There have been many proposals in the past to construct buildings with a series of interconnected re-enforced concrete panels, some of which are prefabricated in a factory and brought to the site such as U.S. Pat. Nos. 4,691,490, 4,934,121 or 4,751,803 while others or poured on site into forms and raised by heavy equipment to construct large buildings such as warehouses or the like. While many proposals have been successful over the years, each embodiment has limitations and inherent problems which as yet have not been totally satisfactory in many cases such as the manner of attaching the panels together to allow for expansion and contraction, cold spots, means of incorporating insulation as well as providing for plumbing, electrical boxes, air conditioning, etc. The present invention addresses these and other problems.

SUMMARY OF THE INVENTION

It is a primary object of the present invention to provide a wall which is a monolithic pour which contains not only an exterior surface but includes supporting structures such as re-enforced studs and re-enforced horizontal fire walls and re-enforced base elements.

It is a further object to provide a wall that is substantially a "sandwich" with an inner and outer structure and an insulation panel in between.

Still another object is to provide a structure in which the inner and outer walls are substantially a mirror image thus substantially requiring one set of forms.

Yet another object is to eliminate "cold spots" by having joints that are covered by insulation.

Still another important object is to provide in between the inner and outer walls not only insulation but an air space to reduce noise levels Still another object is to provide recesses in the inner or outer wall for electrical boxes or plumbing or the like, which does not extend all the way through both walls and insulation but is easily accessible for the workman.

Another object is to provide a simple means to attach the inner and outer walls which requires no hardware such as bolts and nuts, etc.

Yet another object is to provide a corner which has no "cold spots" yet is weather proof with no openings or joints that go all the way through both walls and yet go together and fasten without hardware.

Still another object is to provide a simple means to fasten the walls to a foundation or sub-floor with out any special hardware.

Yet another object is to provide means for the inner and outer wall to independently "creep", that is, expand and contract at different rates to prevent internal stress and cracking.

Another important object is to provide a finished surface on both the exterior wall and the interior wall.

Another object is to provide a slip joint means between the outer panels which allow them to expand and contract.

Still another object is to provide wall structures that can be designed and built in a factory around a basic design which may include openings such as door frames, window frames, power service boxes, etc.

Other objects and advantages will become apparent when taken into consideration with the following specifications and drawings:

BRIEF DESCRIPTION OF THE DRAWINGS

FIG. 4 is a perspective view of a typical panel.

FIG. 5 is a cut-a-way view of a wall section and stud.

FIG. 11 is a sectional view showing a second fastening means.

FIG. 12 is a section taken at 2—2 showing the second fastening means.

FIG. 13 is a top view of the second fastening means.

FIG. 14 is a sectional view showing a typical expansion joint between two completed wall sections.

FIG. 15 is a perspective view of a joining pin for the outer wall.

FIG. 16 is a perspective view of an exterior wall anchoring bracket.

FIG. 17 is a perspective view of an interior wall mounting bracket.

FIG. 18 is a side view of a typical end of a mounting bracket showing a slotted mounting hole.

FIG. 19 is a perspective view of the bracket portion of a second fastening means.

FIG. 20 is a side view of the bracket portion of a second fastening means.

FIG. 21 is a perspective view of the pin portion of a second fastening means.

FIG. 22 is an end view of the pin portion of a second fastening means.

DETAILED DESCRIPTION OF THE DRAWINGS

Figure 1:
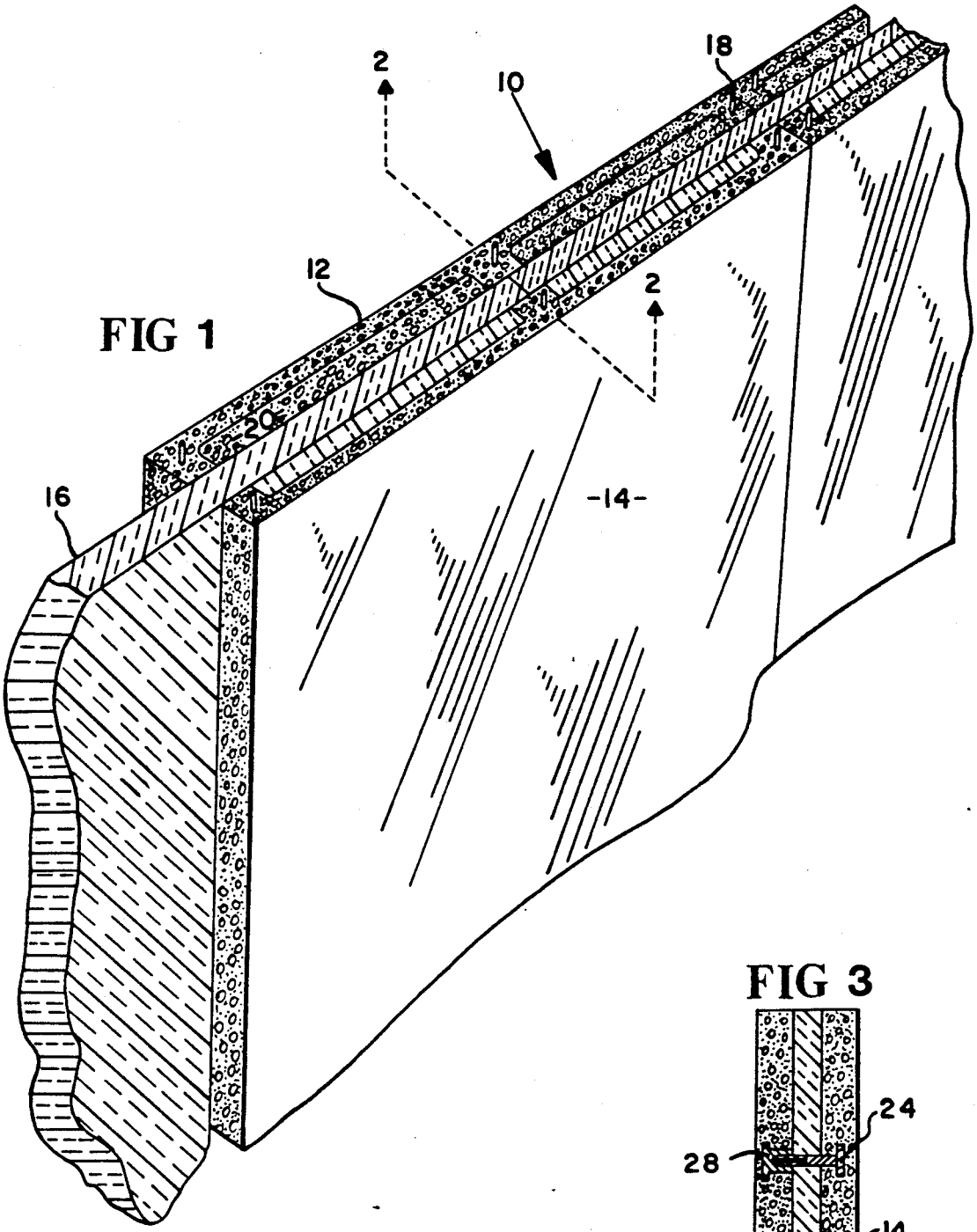
FIG. 1 is a perspective view of an assembled section of a "sandwiched" wall.

Referring now in detail to the drawings wherein like characters refer to like elements throughout the various drawing, in FIG. 1, 10 is a general view of a typical section of a typical finished wall structure of the present invention with 12 being an exterior wall panel, 14 being an interior wall panel while 16 is a section of rigid insulation. It is to be understood that the exterior interior panels may have a finished surface which is determined by the surface of the forms when the panels are poured. The exterior surfaces may take the appearance of bricks, stones, stucco or other pertinent patterns (not shown) while the interior may take the appearance of texture, stipple, wood paneling, ect. (not shown). 18 are either mounting bolts for a wall top plate 90 or the ends of rebar which a top plate 90 may fit over and be anchored with an axle nut. 20 are air cavities formed by the junction of the walls 12 and 14, respectively, with the rigid insulation 16 to not only reduce weight but to provide further insulation and a sound barrier.

Figure 3:
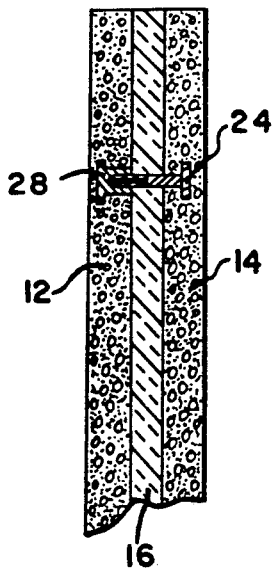
FIG. 3 is a section taken at 2—2 of FIG. 1.
Figure 2:
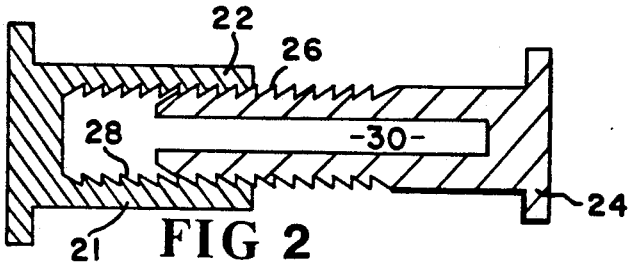
FIG. 2 is a cross-section plan view of a fastening system.
Figure 6:
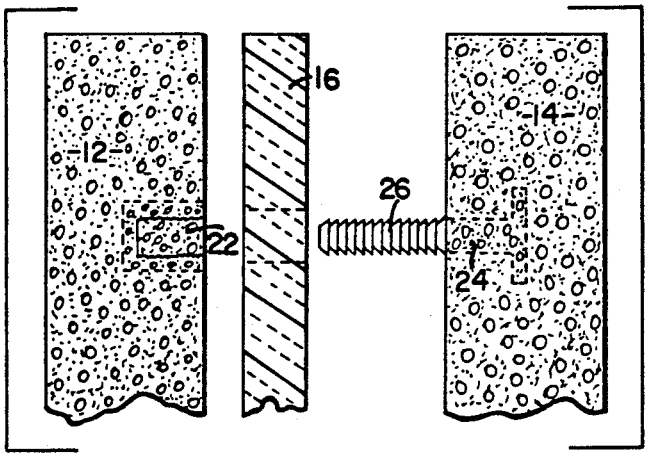
FIG. 6 is a plan view showing a wall section ready to be assembled.

In FIG. 2, 21 is a fastening system with 22 being the female element and 24 being the male element while 26 are teeth cooperating with a second set of teeth 28 while 30 is a slot in the male element 24 to allow the element 24 to flex or spring inward to allow the male element to be forced into the female element, whereby, the matching teeth 26 and 28, respectively, hold the fastening system together at multiple stop positions. FIG. 3 shows the fastening system 21 embedded in the panels and holding the walls 12, 14 and insulation panel 16 together in substantially a "sandwich".

Figure 7:
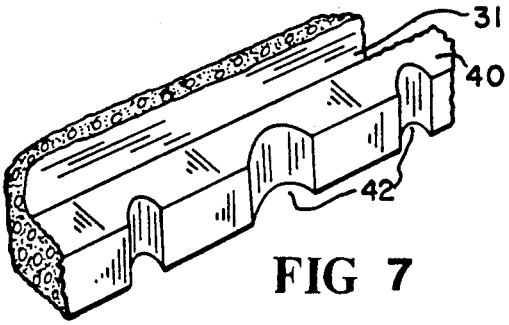
FIG. 7 is a section of a panel showing plumbing indentations.

In FIG. 4, 31 is a typical panel such as an outside panel which shows studs 32, rebar 18, air cavities 20, and holes 34 containing the female elements 22 of fastening system 21, fire blocks and cross braces 36, inside bottom anchoring brackets 38 and bottom element 40. FIG. 7 shows the bottom element 40 having indents 42 suitably formed to except plumbing pipes (not shown) as required.

Figure 10:
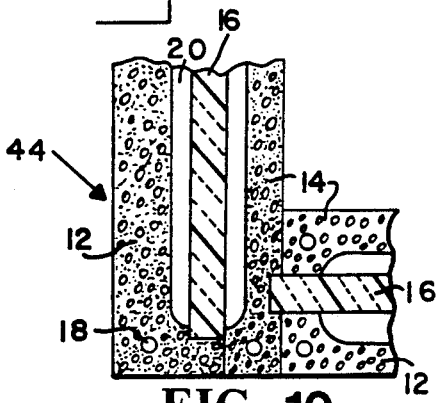
FIG. 10 is a top view showing a typical corner.
Figure 8:
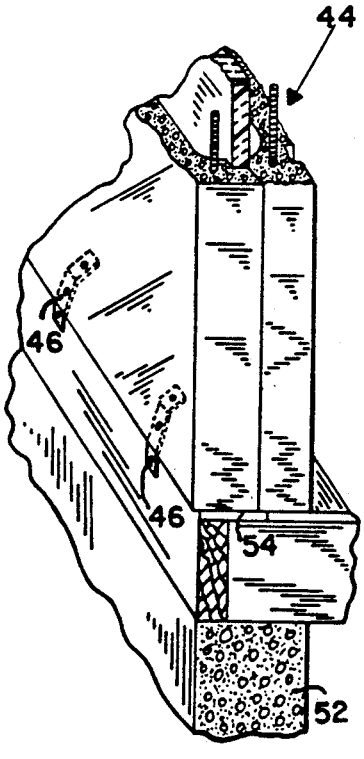
FIG. 8 is a partial cut-a-way, perspective view showing a section of an exterior panel anchoring means and a typical corner.

FIGS. 8 and 10 show a typical outside wall with a corner, 44, formed in a manner to leave a clean outside corner, however, it will be seen that no openings are allowed to go all the way through the wall at any point, being interrupted by insulation. 46 is an outside bottom anchoring bracket containing holes 48, 48 being holes in both brackets 38 and 46, respectively, and being filled with concrete when the wall is poured, while 50 are slotted holes in brackets 38 and 46, respectively. Slotted holes 50, allow the walls to expand and contract independently on it's y—y axis 56 while firmly holding the wall to the foundation 52 or sub-floor 54 on it's x—x axis 58.

FIGS. 11, 12 and 13 show a second embodiment of a fastening system, with 60 being a bracket with legs 62 and 64, respectively, being at an angle to secure the bracket in the concrete wall 12, with 66 being an elongated, tapered slot with it's width at it's upper extremity 68, being larger than it's lower extremity 70. FIG. 21 shows a pin 72 with one end having a head 74 which is buried and held in the inner concrete wall 14 while the distal end of pin 72 has a second head 77, head 77 cooperating with slot 66 of bracket 60 and being small enough to enter slot 66 at it's upper extremity 68 but being too large to pass through slot 66 at it's lower extremity, 70. Also, pin 72 at it's diameter 76 is smaller than the lower extremity 70 of bracket 60. The design of the pin, that is being smaller than the lower extremity of slot 66, again, allows the walls to expand and contract in their y—y axis but holds them in place firmly in their x—x axis. The bracket 60, when located in the exterior wall panel 12 when poured, is mounted at an angle 82 such as 5 degrees, with the pin 72 being mounted at a corresponding angle in interior panel 14, whereby, when the interior panel 14 is raised and the head 77 of pin 72 is inserted in slot 66 of bracket 60 and the interior panel is lowered or dropped, the exterior panel 12, rigid insulation 16 and interior panel 14 are forced together in a "sandwich" and held in a firm manner as the interior panel 14 is now fastened to sub-floor 54 by brackets 38.

Figure 9:
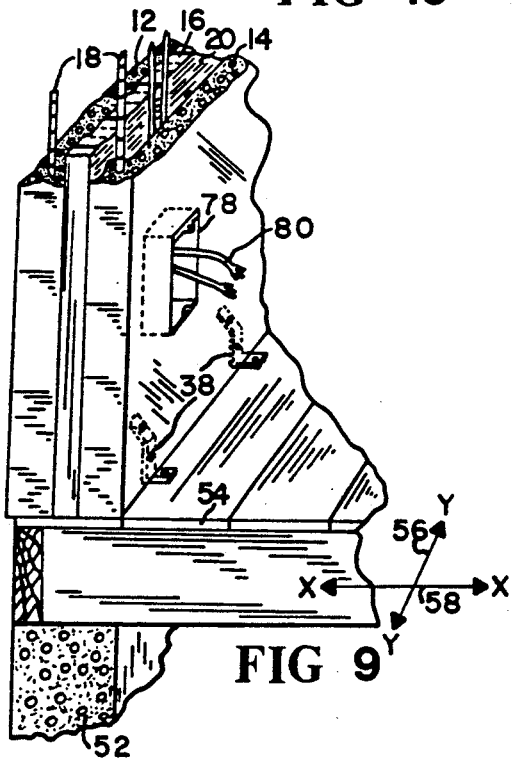
FIG. 9 is a partial cut-a-way, perspective view showing a section of an interior wall with anchoring means to a sub-floor and an electrical box installation.

In FIG. 9, 78 is a typical electrical box installed in the inner wall 14 with wiring 80 installed through the air cavity 20.

FIG. 14 and 15 show a working joint at the junction of two typical wall sections 10 with 84 being a pin, made of material such as steel, which cooperates with cavities 86 and 88, respectively, to allow the walls 10 to expand or contract along their x—x axis. Also, it will be noted that the pin 84 is located in the exterior panels and holds the outer wall together during assembly.

Also, the top plate 90 has slotted holes or oversize holes 92 which cooperate with bolts or rebar 18 to allow the walls to expand or contract.

Figure 23:
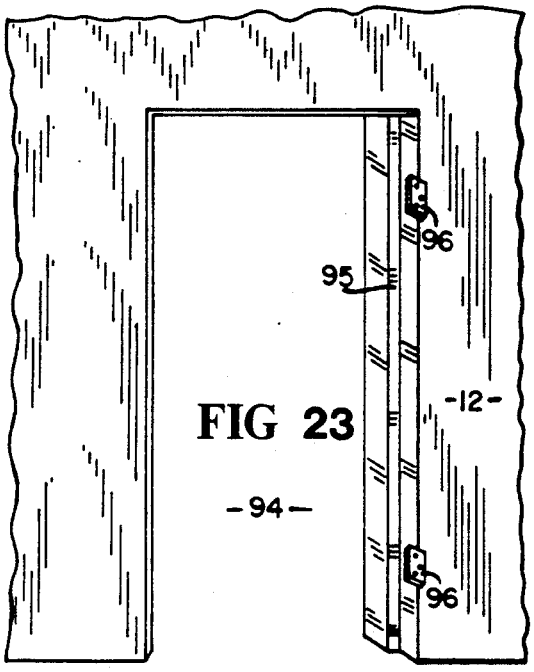
FIG. 23 is a perspective view of a door opening showing hinge cavities and screw holes in the poured concrete panel.
Figure 27:
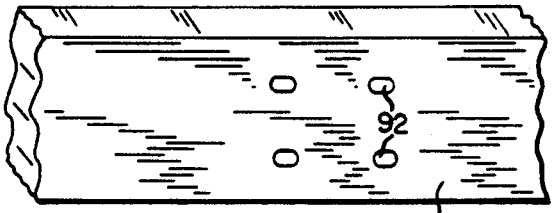
FIG. 27 is a perspective view of a section of a top plate.
Figure 24:
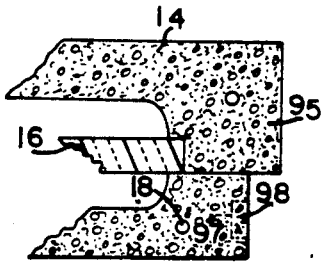
FIG. 24 is a section of a door opening showing the door jam and a cavity with mounting screw holes in the poured concrete panel for a striker receptacle.
Figure 25:
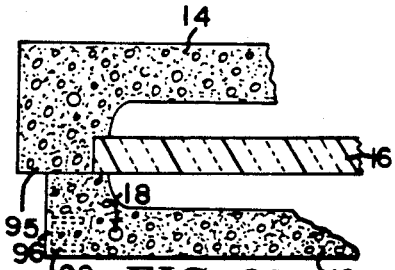
FIG. 25 is a section of a door opening showing the door am and a cavity with mounting screw holes in the poured concrete panel for hinges.

In FIG. 23 a typical opening is shown which, in this case, is a doorway 94 with door jam 95 being part of the interior panel 14 and 96 being hinge cavities in exterior panel 12 and 98 being a cavity in exterior panel 12 to receive a striker receptacle and striker plate (not shown) while 97 and 99, respectively, are screw hole cavities for the striker receptacle and the hinges, respectively.

Figure 26:
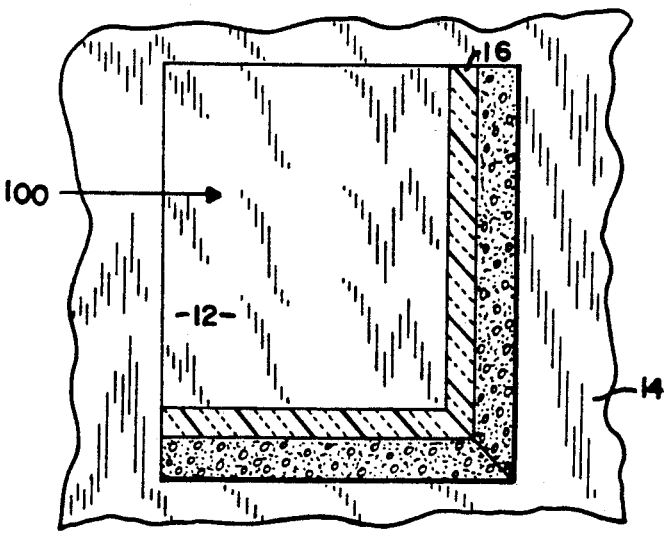
FIG. 26 is a perspective view of a typical cavity for an electrical box or service panel.

FIG. 26 shows an opening 100 for an electrical panel (not shown) or the like which allows a panel to be set against the interior wall 12 with access to air cavity 20 for wiring.

It will now be seen that we have provided a new and unusual design for construction of concrete buildings which allows the inner and outer walls to expand and contract independent of each other with all appropriate fittings, brackets, plates, joints, etc., cooperating with the walls to allow the walls to expand and contract independently.

Also we have provided air space in both the inner and outer walls for sound proofing and further insulation which also allows for easy wiring and plumbing.

We have also provided for inner and outer finished walls with a choice of decor such as brick, rock, stucco, texture, wood paneling, etc.

Also, we have provided a design that has no "cold spots", that is, not insulated such as joints, etc.

We have also provided a structure that is modular and many be fabricated off site and assembled on site, complete with all openings necessary such as windows, doors, electrical service panel opening, electrical boxes, plumbing indents, etc.

We have even provided door jams that are fabricated in the panels and containing cavities for hinges and striker receptacles.

It will also be noted that we have provided an unusual manner to anchor the panels to a sub-floor or foundation which allows the panels to expand and contract independently.

We have also provided two unusual fastening means to assembly the outer wall, rigid insulation and inner wall, together in a "sandwich", with one of the embodiments allowing the assembly to be accomplished by forcing the "sandwich" together straight on, while a second embodiment allows the inner wall to be raised, inserted into brackets built into the outer wall and dropped into place, forcing the walls together.

We have also provided a top plate to cap off the walls which again allows the walls to expand and contract independently.

Also, we have provided a monolithic pour design which includes re-enforced studs, wall panels, re-enforced cross studs, re-enforced bottom plate and re-enforced fire blocks.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embraced any and all equivalent devices and apparatus.

Having described our invention, what we claim as new and desire to secure by letters patent is:

1. A concrete wall comprising; an outer panel, an inner panel, a rigid insulation panel, said outer and said inner panels having at least two up-rising studs, a bottom horizontal member, said horizontal member being substantially the same thickness as said studs, said horizontal member connecting said up-rising studs, said outer and inner panels being of a thickness less than said studs, fastening means to fasten said outer panel, said insulation panel and said inner panel together in substantially a sandwich in which said rigid insulation is between said outer and said inner panels, an air cavity between said inner panel and said rigid insulation, an air cavity between said outer panel and said rigid insulation, said fastening means including multiple pins to attach adjacent panels together at their outer common edges, said adjacent panels having multiple pin cavities, whereby, when said multiple pins are inserted into said multiple pin cavity of one of said panels, said adjacent panel can be installed with it's said multiple pin cavity covering and cooperating with said pins allowing said adjacent panels to expand and contract in relation to each other with said multiple pins having a sliding relationship with said panels, said fastening means including a first outer panel base bracket, said first outer panel base bracket being anchored in said panel with a distal end exposed, said exposed distal end protruding at an angle cooperating with the surface of a supporting base, said exposed distal end having an elongated slot in substantially the end of said exposed end of said bracket, said slot paralleling said panel, said slot being of a size to receive and capture a fastener, whereby, when said outer panel expands or contracts, said elongated slot allows said bracket to slidably engage said base, said fastening means including a second inner base bracket, said second inner base bracket being anchored in said panel with its distal end exposed, said exposed distal end protruding at an angle cooperating with the top of a supporting surface, said exposed distal end having an elongated slot in substantially the end of said exposed end of said bracket, said slot paralleling said panel, said slot being of a size to receive and capture a fastener, whereby, when said inner wall expands and contracts, said elongated slot allows said bracket to slidably engage said base, said fastening means including a third bracket having a mating pin, said third bracket being U-shaped with a common leg having two parallel legs at one of their ends, with the distal ends of said parallel legs being formed at substantially 45 degree angles to anchor said bracket in said outer concrete panel with said common leg of said U-shaped bracket being exposed, said common leg having an elongated, tapered opening, said opening being wider at its upper extremity than at its lower extremity, said mating pin having first and second heads on its ends, said first head being anchored in said inner panel, said second head with a portion of the body of said pin being exposed, said second head being of a size to enter said upper extremity of said elongated, tapered opening of said bracket, said second head being of a size large enough to be retained in said lower extremity of said elongated, tapered opening, said exposed body of said pin being smaller than said width of said lower extremity of said elongated, tapered opening, said bracket and said pin being anchored in said outer and said inner concrete panels at substantially a five degree angle, whereby, when said inner panel is raised higher than said outer panel with said insulation panel set in between, said second heat of said pin can enter said elongated, tapered opening at its upper extremity, and when said inner panel is lowered, said bracket and said pin cooperate together to force said outer panel, said insulation and said inner panel together, said third bracket allowing said inner and outer panels to expand and contract independently, horizontally and vertically, and said fastening means including a top wall plate, said top wall plate being of a size to cover said inner panel, said rigid insulation, and said outer panel, said top wall plate having elongated holes cooperating with a fourth fastening means in the top portion of said inner and outer panels to allow said inner and outer panels to expand and contract independently, said forth fastening means being extended re-bar secured by axle nuts.

2. The concrete wall of claim 1 in which said outer panel has a design on its outer exposed surface.

3. The concrete wall of claim 1 in which said inner panel has a design on its outer exposed surface.

4. The concrete wall of claim 1 in which said studs and said horizontal member have at least one re-enforcing rod.

5. The concrete wall of claim 1 in which said fourth fastening means are bolts and nuts.

6. The concrete wall of claim 1 in which said bottom horizontal member has indents cooperating with plumbing pipes to allow said plumbing pipes to pass through.

7. The concrete wall of claim 1 in which at least one of said panels has an electrical outlet box anchored in its outer surface.

8. The concrete wall of claim 1 in which at least one of said panels has an opening to receive an electrical service panel.

9. The concrete wall of claim 1 in which at least one of said inner panels has an opening to accommodate a door with at least two studs forming door jams, said studs being joined by a cross member to form a top door jam, said studs and said cross member being thicker by the thickness of said insulation panel, said studs and said cross member having an off-set to receive said insulation panel.

10. The concrete wall of claim 1 in which at least one of said outer panels has an opening to accommodate a door with at least two opposing studs being joined by a cross member to form a door frame, said door frame having at least two cavities on the outer edge of one of said studs to accommodate at least two hinge plates, said cavities containing multiple holes to receive said hinge plate mounting screws, said opposing studs having a cavity to receive a striker plate receptacle and said receptacle cavity having multiple screw holes to receive said receptacle mounting screws.

11. The concrete wall of claim 1 in which said top wall plate is made of wood.

* * * * *